US006626247B1

(12) United States Patent
Nordlin

(10) Patent No.: US 6,626,247 B1
(45) Date of Patent: Sep. 30, 2003

(54) MECHANISM TO FASTEN ADAPTORS TO A HEAD PORTION OF A POST DRIVER

(75) Inventor: William F. Nordlin, Rockford, IL (US)

(73) Assignee: Greenlee Textron, Inc., Rockford, IL (US)

( * ) Notice: Subject to any disclaimer, the term of this patent is extended or adjusted under 35 U.S.C. 154(b) by 0 days.

(21) Appl. No.: 09/758,693

(22) Filed: Jan. 11, 2001

(51) Int. Cl.[7] ..... B25D 11/00
(52) U.S. Cl. ..... 173/90; 173/114; 173/136
(58) Field of Search ..... 173/90, 131, 114, 173/136, 91, 135

(56) References Cited

U.S. PATENT DOCUMENTS

| | | | | | |
|---|---|---|---|---|---|
| 2,664,977 | A | * | 1/1954 | Starcevich | 254/100 |
| 3,961,672 | A | * | 6/1976 | Welsch et al. | 173/131 |
| 4,119,159 | A | * | 10/1978 | Arentsen | 173/133 |
| 4,190,118 | A | * | 2/1980 | Sweeney | 173/130 |
| 4,377,355 | A | * | 3/1983 | Chelminski | 172/1 |
| 4,565,251 | A | * | 1/1986 | Cischke | 173/128 |
| D313,999 | S | * | 1/1991 | Conti | D15/21 |
| 5,097,912 | A | * | 3/1992 | Bowers | 173/118 |
| 5,117,924 | A | * | 6/1992 | Bermingham | 173/131 |
| 5,709,057 | A | * | 1/1998 | Johnson et al. | 248/219.2 |
| 5,806,608 | A | | 9/1998 | DuBois | 173/90 |
| 6,158,131 | A | * | 12/2000 | Costanzo et al. | 30/506 |
| 6,173,931 | B1 | * | 1/2001 | Johnson et al. | 248/207 |

OTHER PUBLICATIONS

Stanley Product Catalog, Post Driver PD45 (one page), Jul. 1991.

* cited by examiner

*Primary Examiner*—Rinaldi I. Rada
*Assistant Examiner*—Louis Tran
(74) *Attorney, Agent, or Firm*—Trexler, Bushnell, Giangiorgi, Blackstone & Marr, Ltd.

(57) ABSTRACT

The present invention provides a post driver which includes various post adaptors having different cross-sections. The post adaptors can be attached to, and detached from, a head portion of the post driver. An adaptor is attached to the head portion by retracting a pin in the head portion, sliding the adaptor into slots on the head portion, and releasing the pin such that the pin extends through an aperture of the adaptor. A post having a cross-section comparable to that of the adaptor can then be inserted into the adaptor, allowing the post driver to drive the post into the ground. The adaptor can be removed from the head portion by retracting the pin and sliding the adaptor out of the slots. If another type of post is to be driven into the ground, a corresponding adaptor can be attached to the head portion.

4 Claims, 9 Drawing Sheets

MECHANISM TO FASTEN ADAPTORS TO A HEAD PORTION OF A POST DRIVER

BACKGROUND OF THE INVENTION

The present invention relates to a novel post driver which includes a mechanism to fasten a variety of adaptors to a head portion of the post driver.

Posts have been driven into the ground for many different purposes, such as for sign posts, fence posts, etc. These posts were originally driven into the ground manually, i.e., physically hammering the posts into the ground with a hammer, a mallet, or a sledgehammer. Physically driving the post into the ground is time consuming, very physically demanding, and sometimes inaccurate.

Mechanical post drivers allow a user to drive sign posts into the ground faster and with greater ease. The user, for the most part, only has to hold onto the machine to ensure that the post is being driven into the ground at the right spot. Prior art post drivers have been limited to specific types of posts. For example, the prior art post driver could only be used to drive round posts into the ground as it was designed to only drive this shape of post into the ground. Thus, a user needed different mechanical post drivers to driver different types of posts into the ground.

The use of universal mechanical post drivers then came into being. The universal mechanical post drivers tried to use a design that would allow many different types of posts, such as round, square, channeled, etc., to be driven into the ground by a single post driver. While this was accomplished, because the post drivers were not made exactly for the type of post to be driven into the ground, the post driver was not always able to ensure stability of the post, or exact proper alignment of the post, during the driving process.

Thus, there is a need for a mechanical post driver that can drive many different types of posts into the ground, while still ensuring stability of the post, and proper alignment of the post, during the driving of the post into the ground. The present invention achieves such a need by providing a post driver that can have attached or removed therefrom a plurality of different types of adaptors for different types of posts, whether in size or in shape.

OBJECTS AND SUMMARY OF THE INVENTION

A primary object of the invention is to provide a post driver that has a quick-change front head design that can accommodate several different types of post adaptors.

Another object of the invention is to provide a post driver to drive sign posts where the sign posts are guided by an adaptor which aligns the post driver with the posts.

Yet another object of the invention is to provide a post driver that has a quick-change front head design that can secure several different types of post adaptors.

Still another object of the invention is to provide a post driver that has a quick-change front head design that permits the quick-change of several different types of adaptors without the use of any tools.

Briefly, and in accordance with the foregoing, the present invention provides a post driver which includes various post adaptors having different cross-sections. The post adaptors can be attached to, and detached from, a head portion of the post driver. An adaptor is attached to the head portion by retracting a pin in the head portion, sliding the adaptor into slots on the head portion, and releasing the pin such that the pin extends through an aperture of the adaptor. A post having a cross-section comparable to that of the adaptor can then be inserted into an extending portion of the adaptor and into a bore of the head portion of the post driver. A ram and anvil of the post driver then work together to drive the post into the ground by repeatedly ramming against the end of the post. The adaptor can be removed from the head portion by retracting the pin from the aperture of the adaptor and then sliding the adaptor out of the slots of the head portion. Then, if another type of post is to be driven into the ground, a corresponding adaptor can be attached to the head portion.

BRIEF DESCRIPTION OF THE DRAWINGS

The features of the present invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENTS

Figure 1:
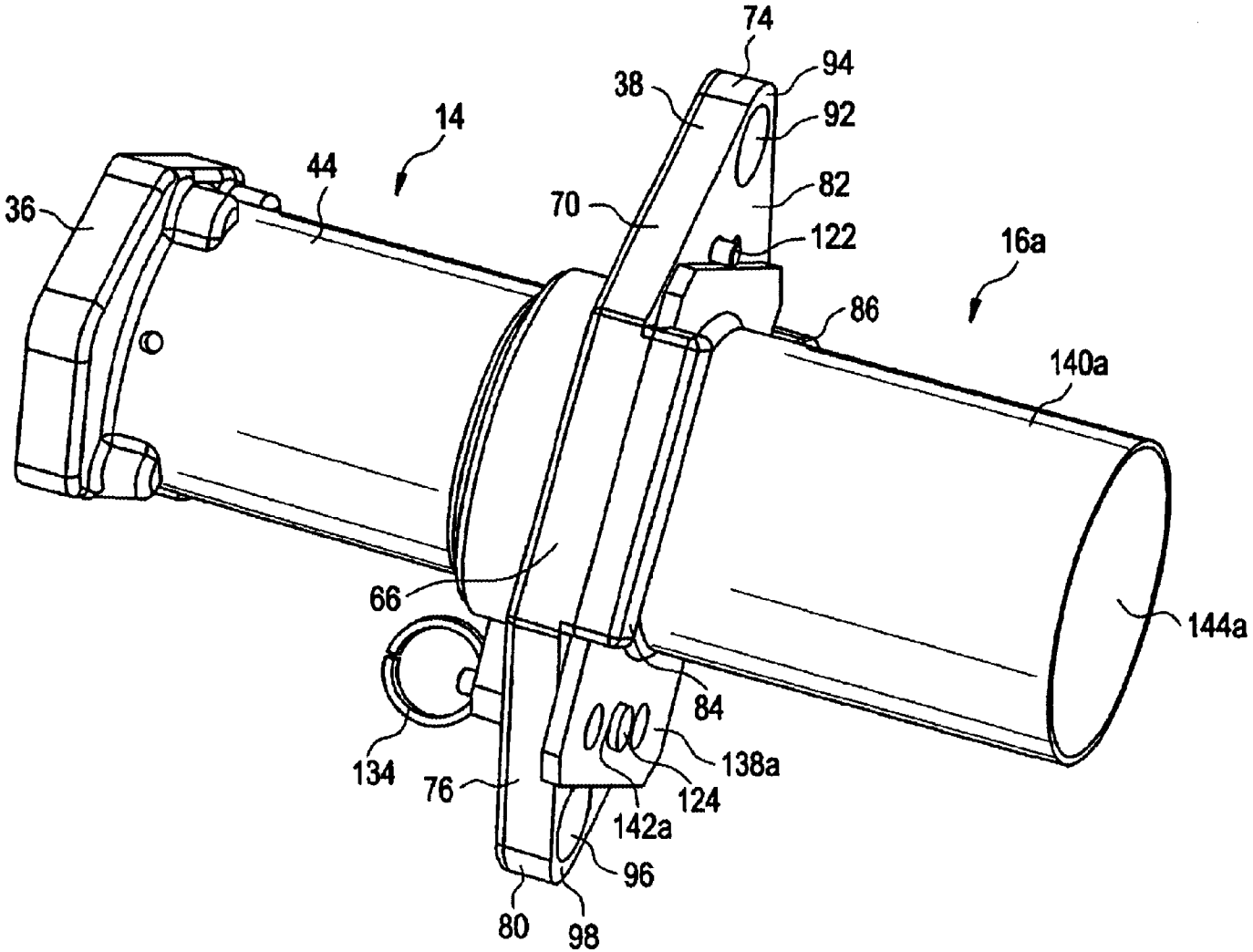
FIG. 1 is a perspective view of a head portion of a post driver having a round adaptor attached thereto.

While this invention may be susceptible to embodiment in different forms, there is shown in the drawings and will be described herein in detail, specific embodiments with the understanding that the present disclosure is to be considered an exemplification of the principles of the invention, and is not intended to limit the invention to that as illustrated.

Figure 2:
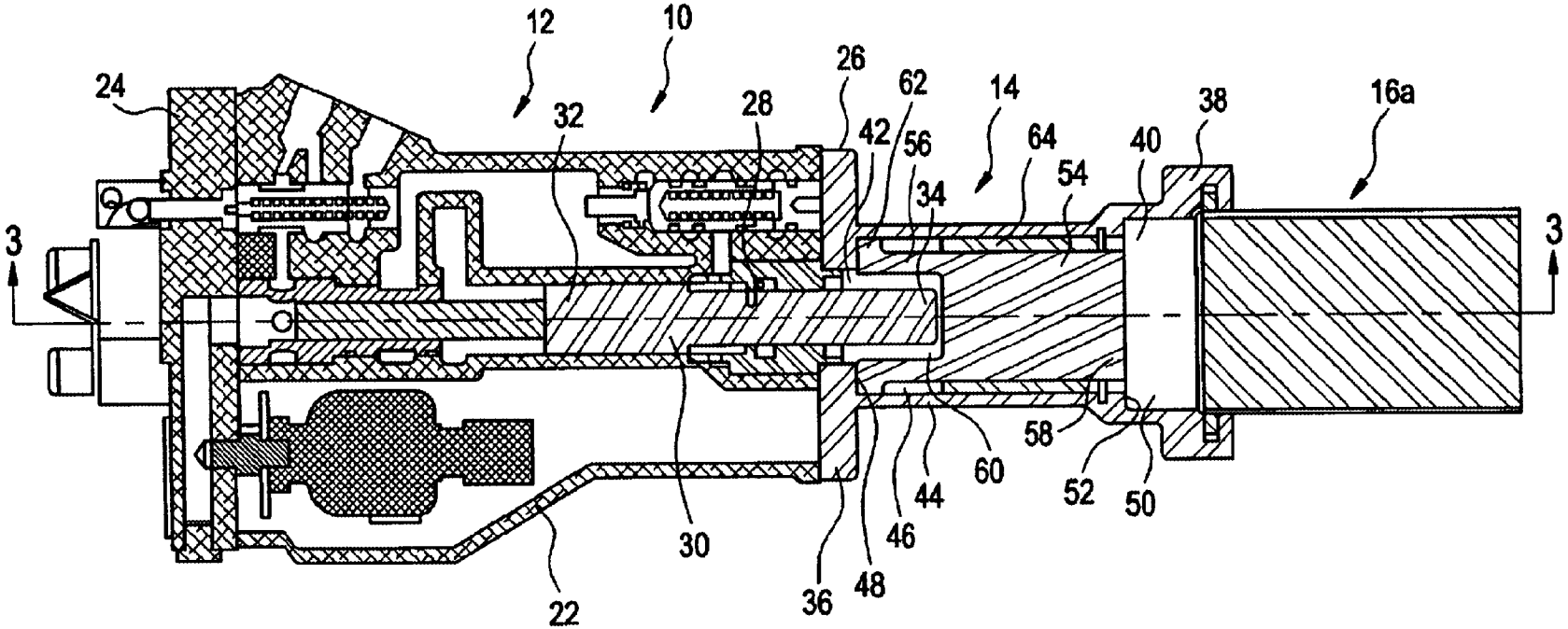
FIG. 2 is a cross-sectional view of the head portion having the round adaptor attached thereto and showing the remainder of the post driver in cross-section as well.
Figure 3:
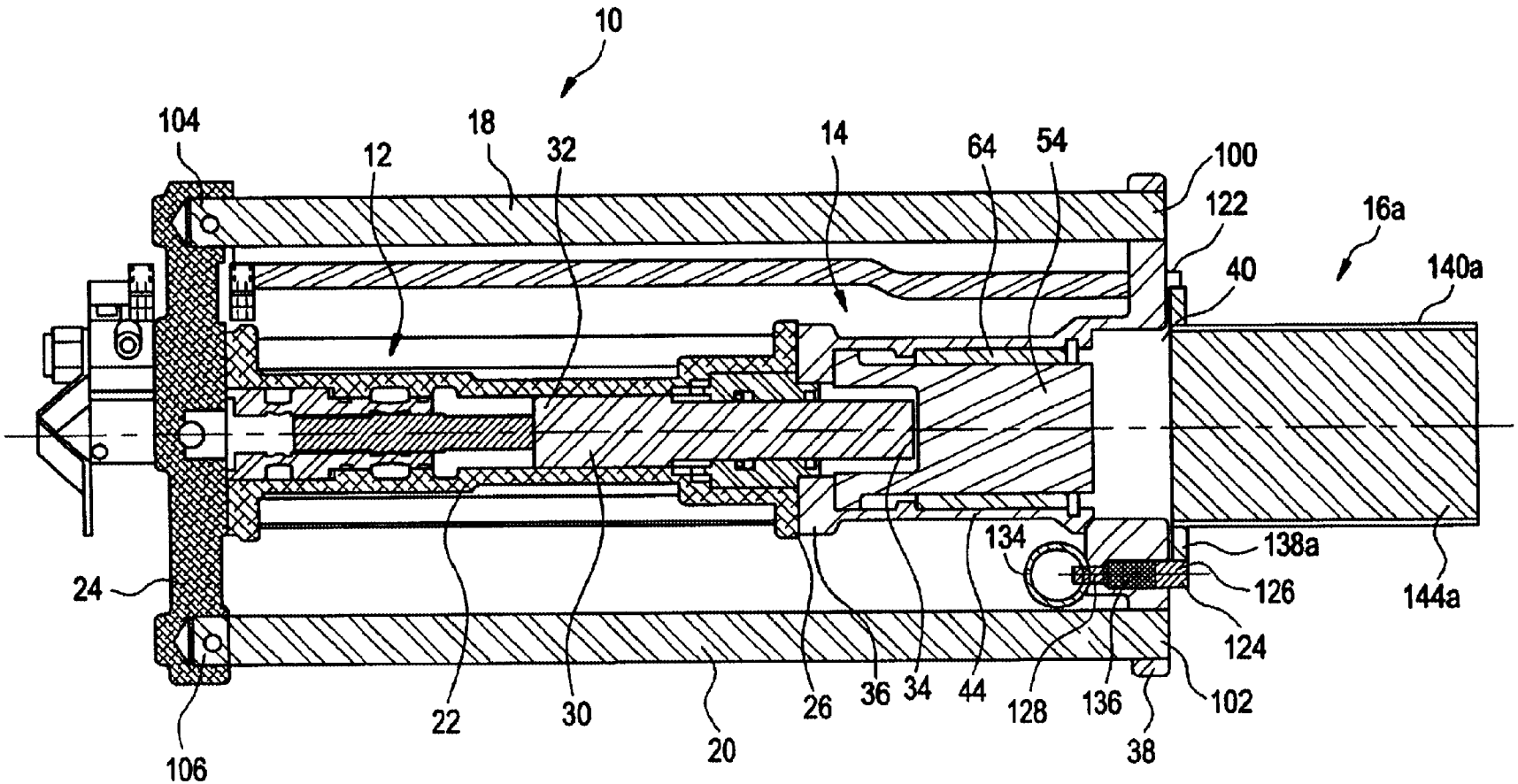
FIG. 3 is a cross-sectional view of the post driver along line 3—3 of FIG. 2.
Figure 10:
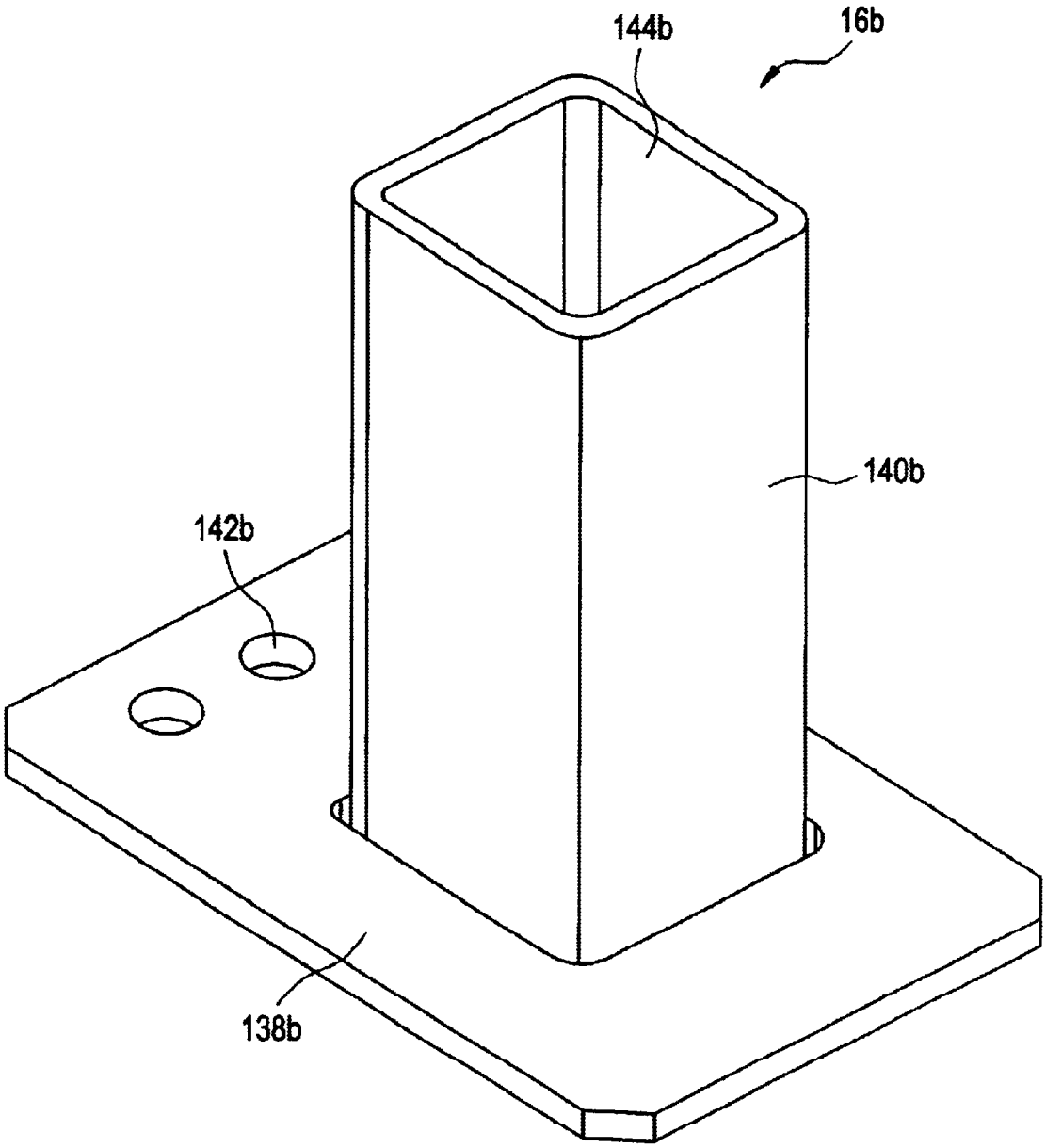
FIG. 10 is a perspective view of a square adaptor.
Figure 11:
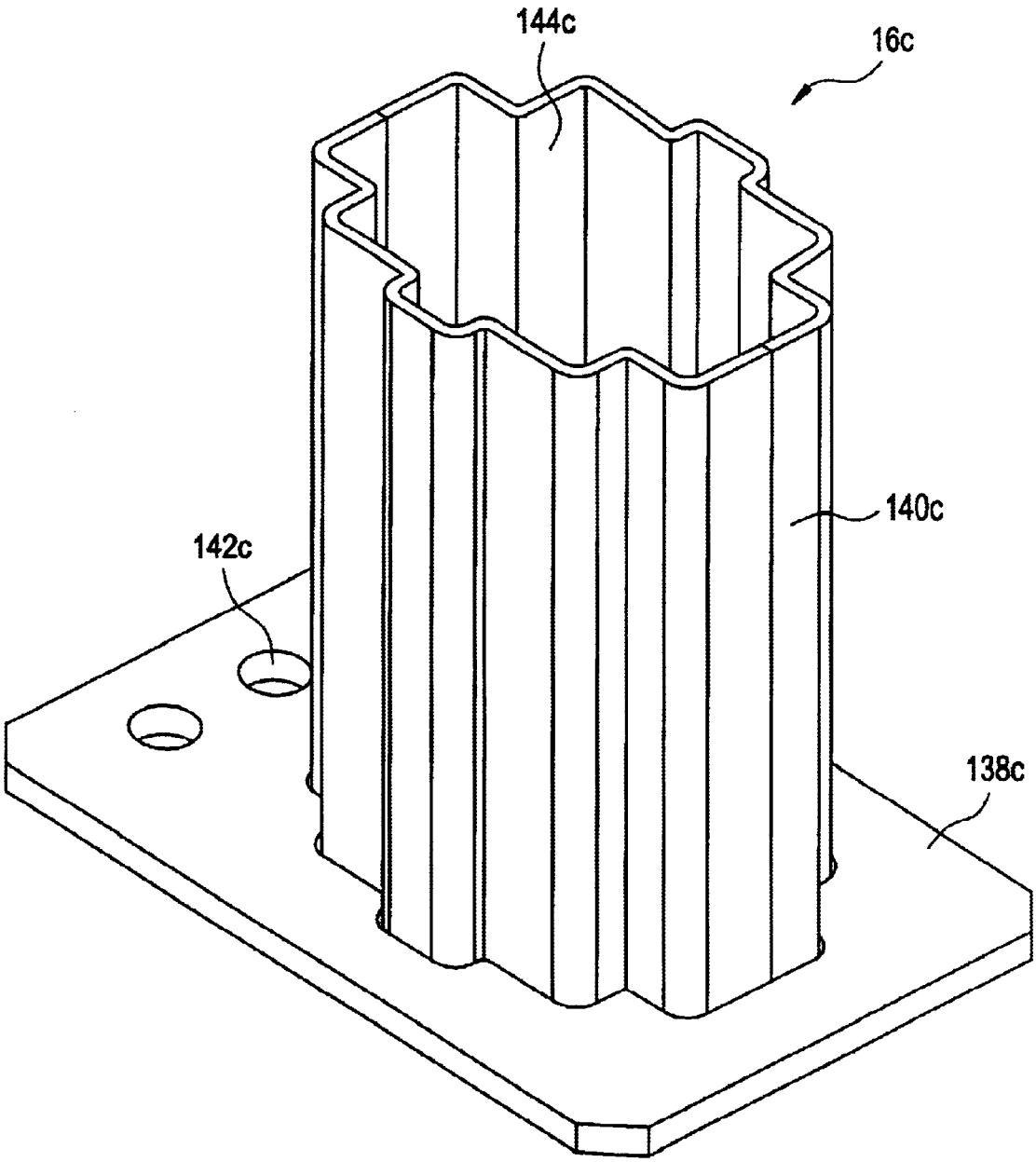
FIG. 11 is a perspective view of a universal adaptor.

Attention is now directed to FIGS. 2–3 which show a post driver 10 in accordance with the present invention. The post driver 10 generally has a body portion 12, a head portion 14, an adaptor 16, and handle bars 18, 20. A variety of adaptors 16*a*, 16*b*, 16*c*, as shown in FIGS. 1, 10 and 11, respectively, can be attached to the head portion 14.

The body portion 12 has a housing 22 for housing numerous mechanical and electrical parts of the post driver 10. Most of the parts of the post driver 10 that are housed within the housing 22 are not discussed herein as they are known in the art.

As best illustrated in FIGS. 2 and 3, the body portion 12 has a first end 24 and a second end 26. The body portion 12 further has a passageway 28 at the second end 26 thereof that extends axially inwardly into the housing 22 toward the first end 24. A ram 30 is positioned within the passageway 28 proximate to the second end 26 such that a first end 32 of the ram 30 is positioned within the passageway 28 in the housing 22 while a second end 34 of the ram 30 is positioned outside of the housing 22. The ram 30 is capable of sliding within the passageway 28 of the body portion 12 by movement imparted to the ram 30 by some of the numerous mechanical and electrical parts that are a part of the body portion 12. The ram 30 will slide such that the first end 32 of the ram 30 moves toward the second end 26 of the body portion 12 and away from its starting point.

The head portion 14 has a first end 36, a second end 38, and a passageway 40 therethrough. It should be noted that the passageway 40 of the head portion 14 preferably has three separate diameters at three different areas of the head portion 14. At the first end 36 of the head portion 14, the passageway 40 has a first portion 42 having a diameter that is slightly larger than a diameter of the ram 30. At a middle portion 44 of the head portion 14, the passageway 40 has a second portion 46 having a diameter that is larger than the diameter of the first portion 42 of the passageway 40. A shoulder 48 is formed at the joint between the first portion 42 and the second portion 46. At the second end 38 of the head portion 14, the passageway 40 has a third portion 50 having a diameter that is larger than the diameter of the second portion 46 of the passageway 40. A shoulder 52 is formed at the joint between the second portion 46 and the third portion 50.

The first end 36 of the head portion 14 is attached to the second end 26 of the body portion 12 such that the passageway 28 of the body portion 12 and the passageway 40 of the head portion 14 are in axial alignment, and communicate, with one another. It should be noted that the head portion 14 could instead be integrally formed with the body portion 12.

The second end 34 of the ram 30 is positioned outside of the housing 22 of the body portion 12, but because the passageway 28 of the body portion 12 is in alignment and communication with the passageway 40 of the head portion 14, the second end 34 of the ram 30 extends through the first portion 42 of the passageway 40 of the head portion 14 and into the second portion 46 of the passageway 40 at the middle portion 44 of the head portion 14.

An anvil 54 is housed within the passageway 40 in the head portion 14. The anvil 54 can slide within the second portion 46 and the third portion 50 of the head portion 14. A first end 56 of the anvil 54 is positioned proximate to the shoulder 48 of the head portion 14 while a second end 58 of the anvil 54 is positioned proximate to the second end 38 of the head portion 14. The anvil 54 has a diameter which is greater than the first portion 42 of the head portion 14 such that the anvil 54 cannot pass into the first portion 42. The first end 56 of the anvil 54 has a recess 60 therein. A protruding collar 62 extends from the first end 56 of the anvil 54. The protruding collar 62 has a diameter that is larger than that of the anvil 54. The protruding collar 62 is further positioned between the shoulder 48 and an anvil bushing 64. The anvil bushing 64 is positioned between the anvil 54 and the head portion 14 in the second portion 46 of the passageway 40. One end of the anvil bushing 64 extends proximate to the shoulder 52. The second end 34 of the ram 30 extends into the recess 60 in the anvil 54. Because the ram 30 is capable of sliding within the passageway 28 of the body portion 12 toward the head portion 14, the anvil 54 is also capable of sliding within the passageway 40 of the head portion 14. The anvil 54 can only move a predetermined distance within the passageway 40 of the head portion 14. When the anvil 54 is at rest, as shown in FIGS. 2 and 3, the first end 56 of the anvil 54 is positioned against the shoulder 48. When the ram 30 is moved, the ram 30 abuts against the anvil 54 so as to move the second end 58 of the anvil 54 into the third portion 50 of the passageway 40 at the second end 38 of the head portion 14. The anvil 54 can only slide within the second portion 46 of the passageway 40 by the force of the ram 30 until the collar 62 of the anvil 54 contacts the anvil bushing 64.

Figure 4:
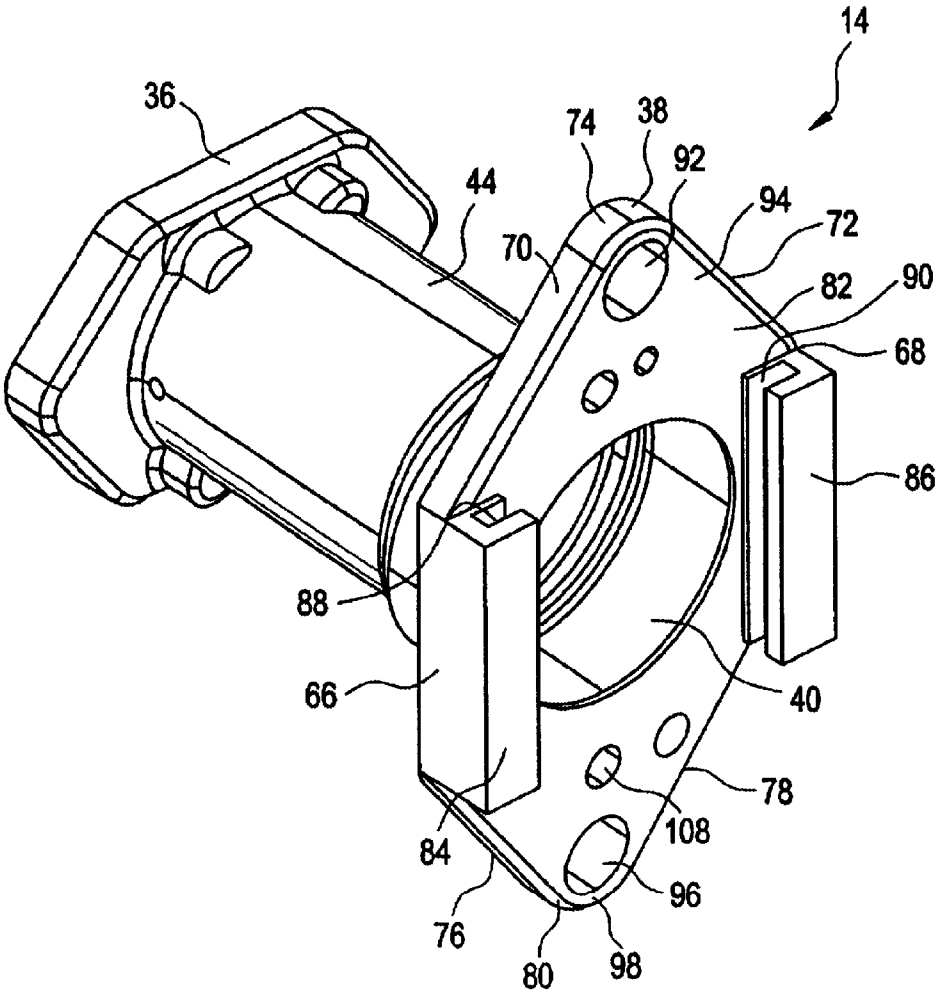
FIG. 4 is a perspective view of a head portion of the post driver.
Figure 5:
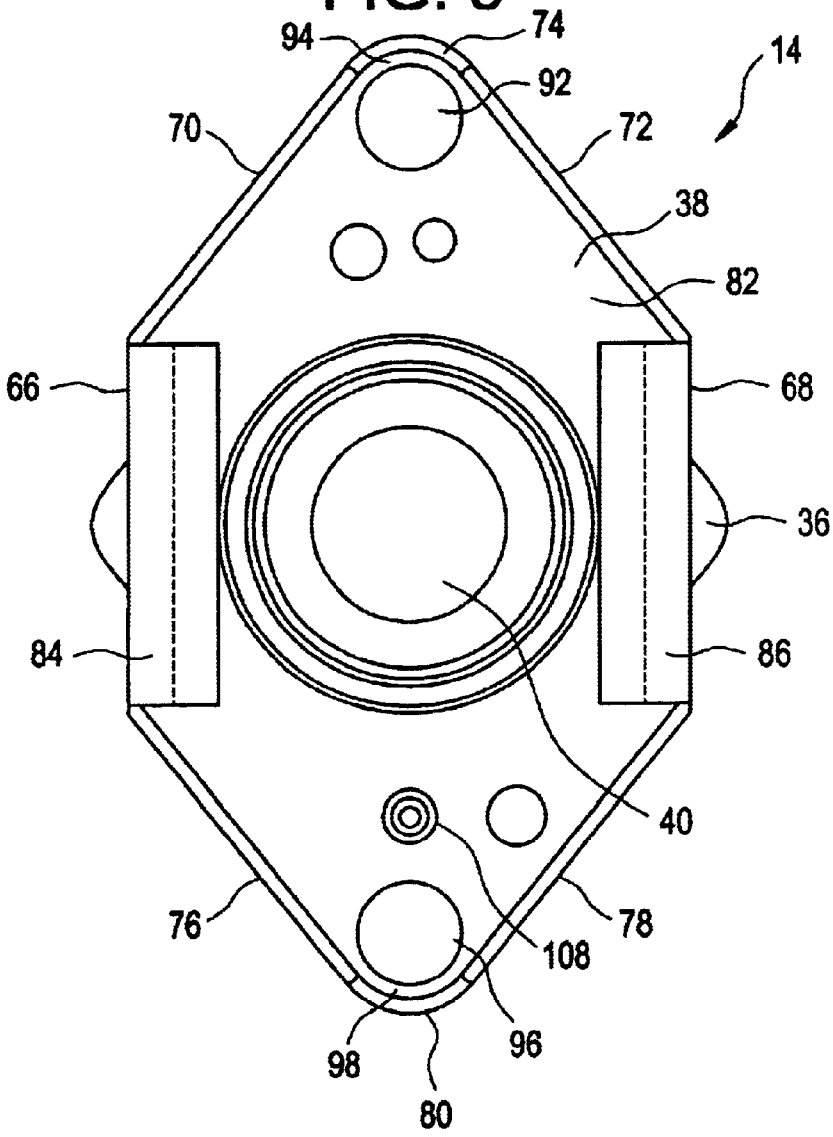
FIG. 5 is a front plan view of the head portion shown in FIG. 4.

As best shown in FIGS. 4 and 5, the second end 38 of the head portion 14 has two vertical sides 66, 68 which are opposite of each other with the passageway 40 therebetween, an angled side 70, 72 extending from one end of each vertical side 66, 68 toward a point where the two angled sides 70, 72 join together at a curved side 74, and an angled side 76, 78 extending from the other end of each vertical side 66, 68 toward a point where the two angled sides 76, 78 join together at a curved side 80. On a front face 82 of the second end 38, an L-shaped portion 84 extends from vertical side 66, and an L-shaped portion 86 extends from vertical side 68. The L-shaped portions 84, 86 do not extend over the opening of the passageway 40 in the second end 38 of the head portion 14. Because the two portions 84, 86 are L-shaped, slots 88, 90 are formed between each L-shaped portion 84, 86 and the front face 82 of the second end 38 of the head portion 14. The slots 88, 90 are sized so that the adaptor 16, discussed in detail herein, can slide into the slots 88, 90.

An aperture 92 is provided through a top side 94 of the second end 38 of the head portion 14 proximate to the curved side 74. Likewise, an aperture 96 is provided through a bottom side 98 of the second end 38 of the head portion 14 proximate to the curved side 80.

The aperture 92 and the aperture 96 each accept an end 100, 102, respectively, of the handle bars 18, 20. The opposite ends 104, 106 of the handle bars 18, 20 are connected to the first end 24 of the body portion 12. The handle bars 18, 20 allow a user to hold onto and direct the post driver 10 while the post driver 10 is driving posts into the ground.

Figure 7:
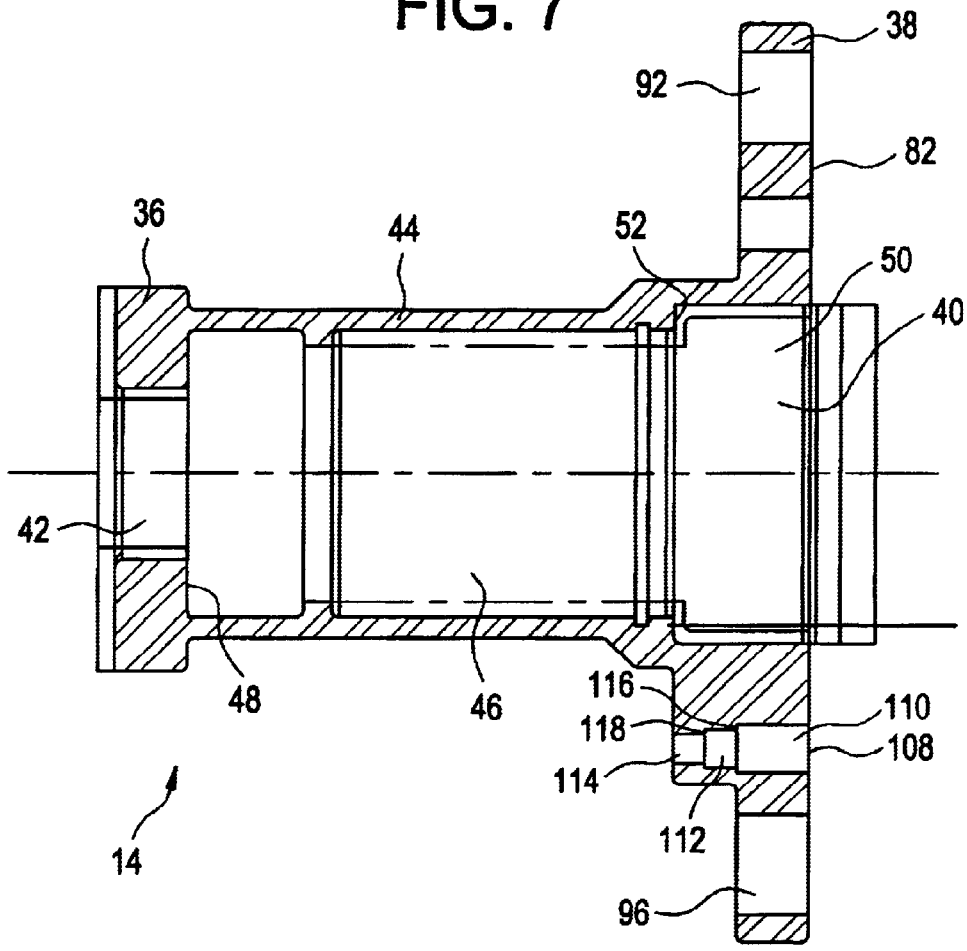
FIG. 7 is a cross-sectional view of the head portion along line 7—7 of FIG. 6.
Figure 8:
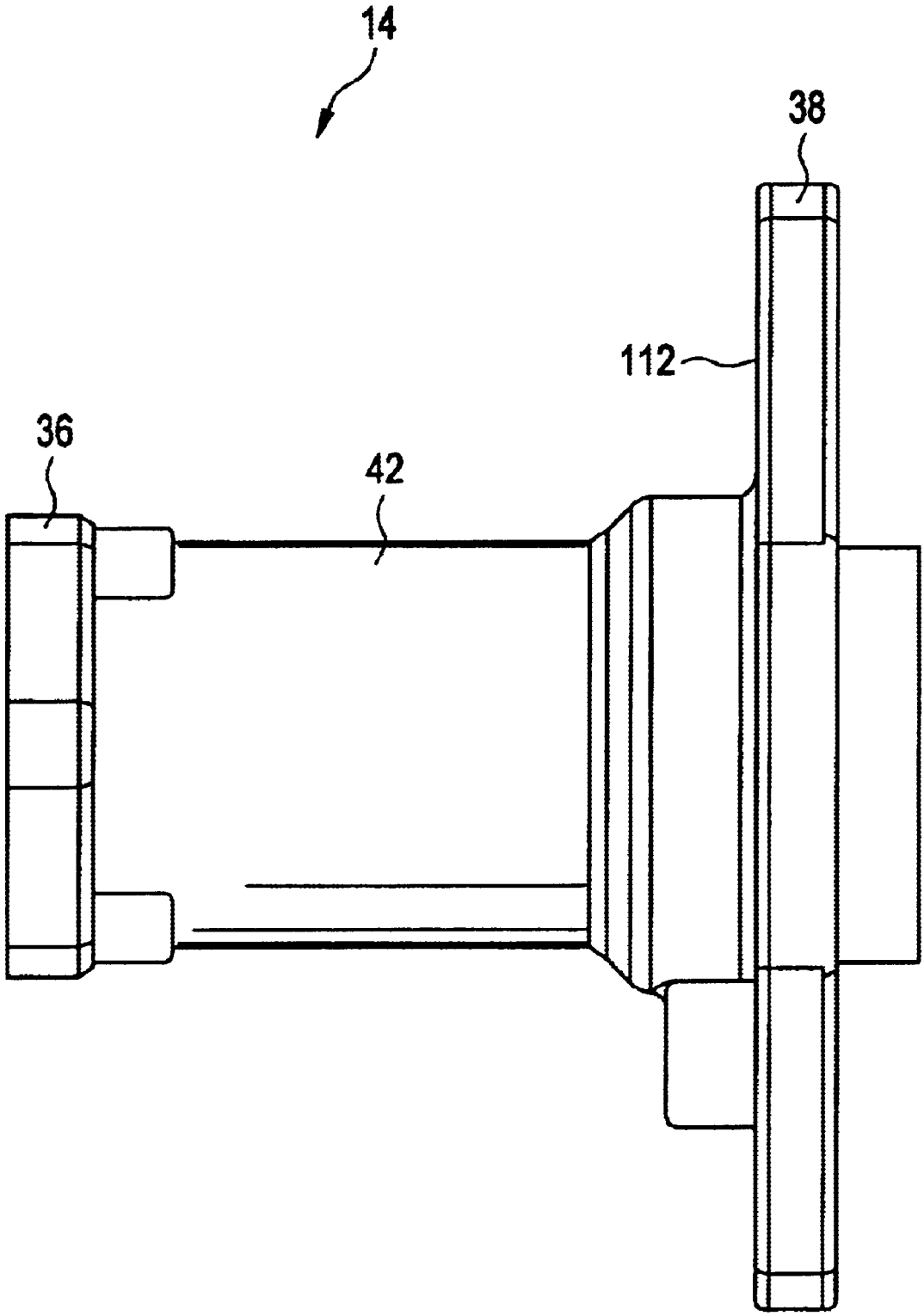
FIG. 8 is a side plan view of the head portion shown in FIG. 4.

An aperture 108 is provided through the second end 38 of the head portion 14. The aperture 108 is axially aligned with, and situated between the aperture 96 and the passageway 40. As best illustrated in FIG. 7, the aperture 108 has three separate portions 110, 112, 114 therein that are defined by a pair of shoulders 116, 118. The first portion 110 of the aperture 108 has a predetermined diameter and opens on the front face 82 of the second end 38 of the head portion 14. The second portion 112 of the aperture 108 is rearward of the first portion 110 of the aperture 108 and has a diameter which is smaller than a diameter of the first portion 110. The first portion 110 and the second portion 112 are separated by the shoulder 116. The third portion 114 of the aperture 108 is rearward of the second portion 112 of the aperture 108 and has a diameter which is smaller than the diameter of the second portion 112. The second portion 112 and the third portion 114 are separated by the shoulder 118. The third portion 114 of the aperture 108 opens on a back face 120 of the second end 38 of the head portion 14.

Other apertures can be provided through the second end 38 of the head portion 14 as needed and where allowed based on the structure and operation of the post driver 10. One such aperture can house a portion 122 that acts as a stop for the adaptor 16, as shown in FIG. 1.

Figure 9:
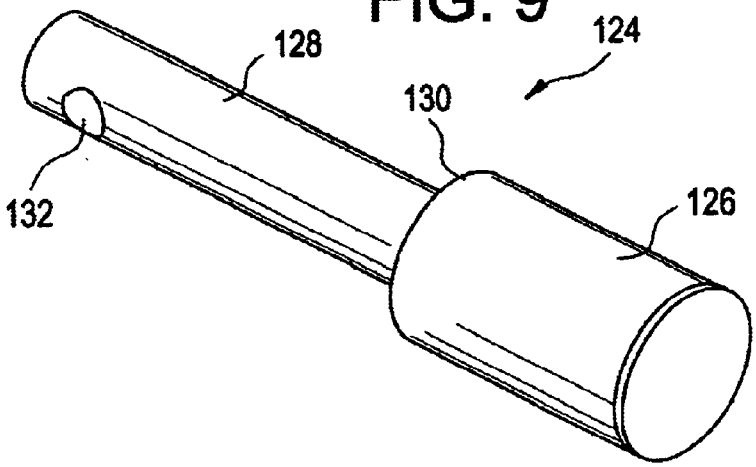
FIG. 9 is a perspective view of a pin used in the head portion of the post driver.
Figure 6:
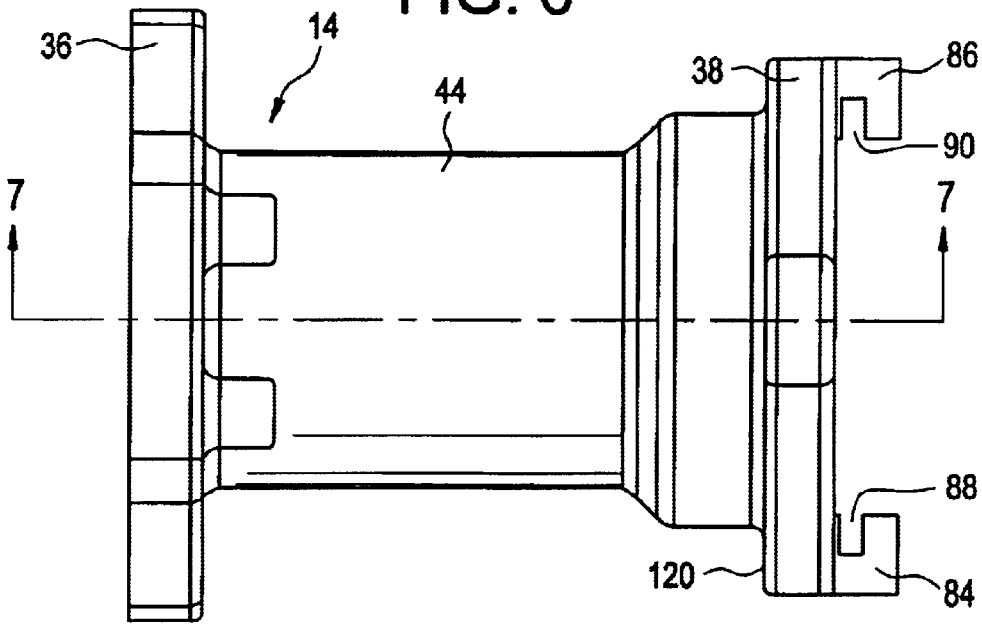
FIG. 6 is top plan view of the head portion shown in FIG. 4.

A pin 124 which can be seen in FIG. 9, is housed in the aperture 108. The pin 124 has a first portion 126 and a second portion 128. The first portion 126 of the pin 124 has a diameter that is larger than a diameter of the second portion 128 of the pin 124. A shoulder 130 is formed at the joint between the first portion 126 and the second portion 128. The second portion 128 of the pin 124 has an aperture 132 therein which accepts a split ring 134. The diameter of the first portion 126 of the pin 124 is slightly less than the diameter of the first portion 110 of the aperture 108, while the diameter of the second portion 128 of the pin 124 is slightly less than the diameter of the third portion 114 of the aperture 108. The second portion 128 of the pin 124 extends out of the aperture 108 on the back face 120 of the second end 38 of the head portion 14, through the third portion 114 and second portion 112 of the aperture 108 and into the first portion 110 of the aperture 108. The first portion 126 of the pin 124 extends from the second portion 128 of the pin 124 in the first portion 110 of the aperture 108, out of the aperture 108 on the front face 82 of the second end 38 of the head portion 14.

A normally expanded spring 136 is placed around the second portion 128 of the pin 124 such that when the pin 124 is positioned in the aperture 108, the normally expanded spring 136 abuts against the shoulder 130 of the pin 124 and the shoulder 118 of the aperture 108. The normally expanded spring 136 forces the first portion 126 of the pin 124 to extend out of the aperture 108 to the front face 82 of the second end 38 of head portion 14. The split ring 134 prevents the pin 124 from escaping the aperture 108 because of the force exerted on the pin 124 by the spring 136.

The pin 124 is used in conjunction with the slots 88, 90 formed by the L-shaped extending portions 84, 86, and the stop portion 122 to allow for the selective attachment to the head portion 14, and release from the head portion 14, of a number of different types of adaptors 16. Three different types of. adaptors 16*a*, 16*b*, and 16*c* will be described herein with the understanding that other types of adaptors could also be used depending on the type of post that is to be driven by the post driver 10.

The adaptors 16*a*, 16*b* and 16*c* are shown in FIGS. 1, 10 and 11. Each adaptor 16*a*, 16*b*, and 16*c* is formed of a plate 138*a*, 138*b*, 138*c* and a portion 140*a*, 140*b*, 140*c* which extends therefrom. The plate 138*a*, 138*b*, 138*c* of each adaptor 16*a*, 16*b*, 16*c* is generally rectangular and has a thickness that is slightly less than a thickness of the slots 88, 90 that are defined between the L-shaped portions 84, 86 and the front face 82 of the second end 38 of the head portion 14. The thickness of each plate 138*a*, 138*b*, 138*c* is slightly less than the thickness of the slots 88, 90 because the plates 138*a*, 138*b*, 138*c* of the adaptors 16*a*, 16*b*, 16*c* slide into, or slide out of, the slots 88, 90. The width of each plate 138*a*, 138*b*, 138*c* is slightly less than a distance between the slots 88, 90 of the L-shaped portions 84, 86 because the plates 138*a*, 138*b*, 138*c* of the adaptors 16*a*, 16*b*, 16*c* slide into, or slide out of, the slots 88, 90. Of course, only one adaptor 16 is be slid into, or slid out of, the slots 88, 90 at any one time.

The plates 138*a*, 138*b*, 138*c* of the adaptors 16*a*, 16*b*, 16*c* have an aperture 142*a*, 142*b*, 142*c* therethrough that will align with, and be in communication with, the aperture 108 through the second end 38 of the head portion 14. The aperture 142*a*, 142*b*, 142*c* of the plate 138*a*, 138*b*, 138*c* has a diameter that is commensurate with the diameter of the first portion 110 of the aperture 108. When the adaptor 16*a*, 16*b*, 16*c* is attached to the second end 38 of the head.portion 14, the operation of which will be discussed herein, the first portion 126 of the pin 124 will extend into the aperture 142*a*, 142*b*, 142*c* of the plate 138*a*, 138*b*, 138*c*, to help connect the adaptor 16*a*, 16*b*, 16*c* to the second end 38 of the head portion 14.

Each adaptor 16*a*, 16*b*, 16*c* has a passageway 144*a*, 144*b*, 144*c* that extends through the plate 138*a*, 138*b*, 138*c* and the portion 140*a*, 140*b*, 140*c*. The passageway 144*a* of adaptor 16*a*, as shown in FIG. 1, has a generally circular cross-section and is capable of receiving circular posts. The passageway 144*b* of adaptor 16*b*, as shown in FIG. 10, has a generally square cross-section and is capable of receiving square posts. The passageway 144*c* of adaptor 16*c*, as shown in FIG. 11, has a cross-section that is neither circular nor square, but rather is described as a universal cross-section. The universal cross-sectioned passageway 144*c* is capable of receiving numerous types of posts, including, but not limited to, circular posts, square posts, flanged channel posts, and delineator posts.

An operation of the use of the post driver 10 of the present invention will now be discussed. If the user needs to drive a round post into the ground, the user attaches the adaptor 16*a* to the second end 38 of the head portion 14 of the post driver 10. A user attaches the adaptor 16*a* to the second end 38 of the head portion 14 of the post driver 10 by retracting the pin 124 by pulling on the split ring 134 and compressing the spring 136 so that the first portion 126 of the pin 124 does not extend out of the aperture 108. The user then slides the plate 138*a* of the adaptor 16*a* into the slots 88, 90 until the adaptor 16*a* abuts against stop portion 122. This aligns the passageway 144*a* of the adaptor 16*a* with the passageway 40 of the head portion 14 of the post driver 10. This further aligns the aperture 108 with the aperture 142*a* of the plate 138*a*. When the aperture 108 is aligned with the aperture 142*a* of the plate 138*a*, the user can release the split ring 134, allowing the first portion 126 of the pin 124 to extend out of the aperture 108 and into the aperture 142*a* of the plate 138*a*.

The user then slides the round post into the passageway 144*a* of the portion 140*a* of the adaptor 16*a* until the round post is in the third portion 50 of the passageway 40 of the head portion 14 at the second end 38 of the head portion 14. The portion 140*a* of the adaptor 16*a* allows the user to properly guide and stabilize the post when the post is being driven into the ground.

Next, the user places the end of the post that is not within the post driver 10 at the spot on the ground where the post is to be driven into. The user turns on the post driver 10 by suitable means such that the ram 30 repeatedly abuts against the anvil 54 which, in turn, repeatedly abuts against the post. The repeated action of the anvil 54 hitting the post drives the post into the ground. When the post has been driven far enough into the ground to suit the applicable requirements, the user turns off the post driver 10 by suitable means and slides the post out of the adaptor 16*a*.

If the user wants to drive a square post in the ground, the user would remove the adaptor 16*a* from the head portion 14 by pulling on the split ring 134 to compress the spring 136 and force the first portion 126 of the pin 124 to retract from the aperture 142*a* of the plate 138*a* into the aperture 108. The user then slides the plate portion 138*a* out of the slots 88, 90 and remove the adaptor 16*a* from the post driver 10.

The user then attaches the square adaptor 16*b* to the head portion 14 in the same manner as previously described in the attachment of the round adaptor 16*a* to the head portion 14.

The same procedure is used to attach the universal adaptor 16*c* to the head portion 14.

Thus, the user can quickly and easily attach and detach numerous types of adaptors to the head portion 14 dependent upon the type of post to be driven into the ground; Such ease of attachment and detachment allows the user to use only one single post driver that has the capability of driving many different types of posts into the ground with the use of a number of different types of adaptors.

The passageway 144 of the adaptor 16 can have different sized and shaped cross-sections to accommodate every type of post that the user could envision driving into the ground. The adaptor 16 ensures stabilization and guidance of the posts during the driving process.

While embodiments of the present invention are shown and described, it is envisioned that those skilled in the art may devise various modifications without departing from the spirit and scope of the foregoing description.

The invention is claimed as follows:

1. A post driver comprising:

a body portion;

a head portion provided at an end of said body portion, said head portion having a passageway therethrough, said head portion has a pair of portions extending from said head portion on opposite sides of said passageway, each said portion defining a slot, said head portion has an aperture therethrough;

a plurality of adaptors, each of which can be selectively attached to and released from said head portion, each of said plurality of adaptors having a passageway therethrough into which a post can be inserted, each said adaptor has an aperture therethrough, each said adaptor configured to be inserted into said slots, whereby insertion of said adaptor into said slots assists in aligning said apertures of said head portion and each said adaptor, each of said plurality of adaptors having a different cross-section along at least a portion of the respective passageway; and a hand-manipulated fastener for allowing one of said plurality of adaptors to be attached thereto and released therefrom, and thereafter replaced by another one of said plurality of adaptors, said hand-manipulated fastener being a spring-loaded pin capable of extending through said apertures of said head portion and each said adaptor when said apertures are aligned to releasably connect each said adaptor to said head portion.

2. A method of securedly attaching an adaptor to a post driver, said method comprising the steps of:

a) providing said post driver which includes a head portion having a passageway and an aperture therethrough, said head portion having a pair of portions extending therefrom on opposite sides of said passageway, each said portion defining a slot;

b) providing said adaptor which includes a passageway therethrough into which a post can be inserted, said adaptor having an aperture therethrough;

c) providing a spring loaded pin within said aperture of said head portion, said spring loaded pin extending out of said aperture of said head portion in a non-compressed state, said spring loaded pin having a gripping mechanism at an end thereof;

d) manually pulling said gripping mechanism of said spring loaded pin to move said spring loaded pin into a compressed state such that said spring loaded pin does not extend out of said aperture of said head portion;

e) manually sliding said adaptor into said slots to align said apertures of said head portion and said adaptor and to align said passageways of said head portion and said adaptor; and f) manually releasing said gripping mechanism of said spring loaded pin to move said spring loaded pin into said non-compressed state such that said spring loaded pin extends out of said aperture of said head portion and into said aperture of said adaptor, thereby securing said adaptor to said head portion.

3. A method of releasing an adaptor which is securedly attached to a post driver, said method comprising the steps of:

a) providing said post driver which includes a head portion having a passageway and an aperture therethrough, said head portion having a pair of portions extending therefrom on opposite sides of said passageway, each said portion defining a slot;

b) providing said adaptor which includes a passageway therethrough into which a post can be inserted, said adaptor having an aperture therethrough, said adaptor being positioned within said slots such that said apertures of said head portion and said adaptor are in alignment and such that said passageways of said head portion and said adaptor are in alignment;

c) providing a spring loaded pin which is extended through said apertures of said head portion and said adaptor, said spring loaded pin being in a non-compressed state, said spring loaded pin having a gripping mechanism at an end thereof;

d) manually pulling said gripping mechanism of said spring loaded pin to move said spring loaded pin into a compressed state such that said spring loaded pin does not extend into said aperture of said adaptor;

e) manually sliding said adaptor out of said slots to separate said adaptor from said head portion; and f) manually releasing said gripping mechanism of said spring loaded pin to move said spring loaded pin into said non-compressed state such that said spring loaded pin extends out of said aperture of said head portion.

4. A post driver as defined in claim 1, wherein an end of said passageway of said head portion is not covered by said portions defining said slots.

* * * * *